US005186617A

United States Patent [19]

Ho

[11] Patent Number: 5,186,617

[45] Date of Patent: Feb. 16, 1993

[54] RECIRCULATION AND PLUG FLOW COMBUSTION METHOD

[75] Inventor: Min-Da Ho, Somers, N.Y.

[73] Assignee: Praxair Technology, Inc., Danbury, Conn.

[21] Appl. No.: 788,603

[22] Filed: Nov. 6, 1991

[51] Int. Cl.[5] ..... F23M 3/00

[52] U.S. Cl. ..... 431/9; 431/10; 431/187; 431/190

[58] Field of Search ..... 431/9, 5, 8, 10, 174, 431/175, 187, 190, 115, 116; 110/235, 238, 241, 348, 346, 345, 216, 213, 204; 423/540, 542

[56] References Cited

U.S. PATENT DOCUMENTS 4,395,223 7/1983 Okigami et al. ..... 431/10
4,861,262 8/1989 Gitman et al. ..... 431/5
4,863,371 9/1989 Ho ..... 431/9
4,957,050 9/1990 Ho ..... 110/346
4,969,814 11/1990 Ho et al. ..... 431/8
5,000,102 3/1991 Ho ..... 110/346
5,022,332 6/1991 Ding ..... 110/346

OTHER PUBLICATIONS

Chemical Engineering, Dec. 1989, pp. 17, 19, 79–81.

*Primary Examiner*—Larry Jones
*Attorney, Agent, or Firm*—Stanley Ktorides

[57] ABSTRACT

A combustion method employing fuel-rich combustion with an upstream recirculation zone followed by a downstream plug flow zone enabling rapid heating and processing without excessive $NO_x$ generation or particulate emissions.

17 Claims, 3 Drawing Sheets

Fig. 3
(PRIOR ART)
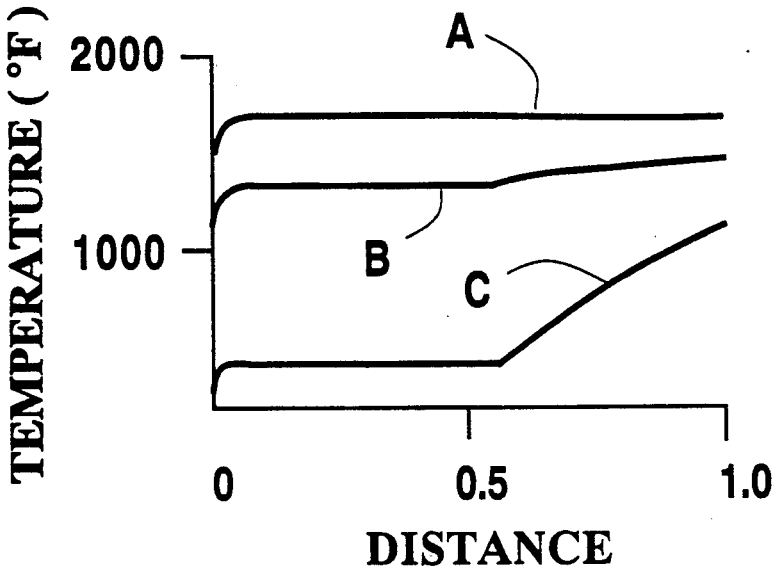
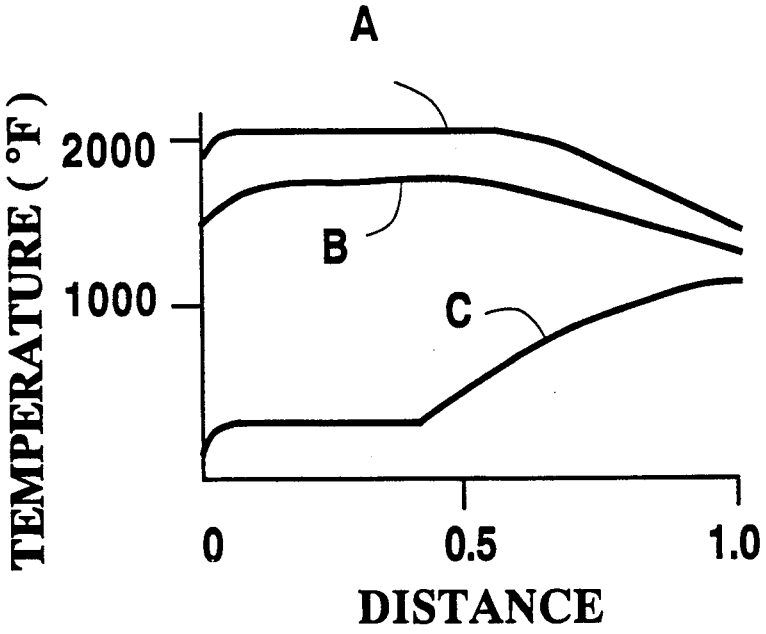
Fig. 4

RECIRCULATION AND PLUG FLOW COMBUSTION METHOD

TECHNICAL FIELD

This invention relates generally to combustion and is especially useful for incineration such as incineration of hazardous waste.

BACKGROUND ART

A recent significant advancement in the field of combustion is the recirculation combustion process, particularly applicable to the incineration of hazardous waste, invented by Dr. Min-Da Ho and disclosed and claimed in U.S. Pat. No. 4,863,371. By means of this recirculation process, combustion is carried out with a very even gas temperature distribution resulting in high efficiency combustion with low $NO_x$ generation.

One problem with moderate and even gas temperature distribution is that it may take a significant space to pass sufficient heat from the combustion reaction to the charge such as solid and/or liquid waste. An evenly high gas temperature distribution would create excessively hot flue gas, low fuel efficiency, high gas flow rate and high particulate carryover. Combustion processes generating high heat flux are known, but they are characterized by the creation of hot spots and the difficulty in controlling solid discharge temperatures. Another common problem of conventional processes is the entrainment of a large amount of particulate matter. Furthermore, the hot spots and generally uneven heating tend to generate large amounts of nitrogen oxides ($NO_x$).

Accordingly it is an object of this invention to provide a combustion method which can rapidly transfer a large amount of heat to a charge, such as waste, while avoiding potential overheating and the release of excessive amounts of pollutants, such as $NO_x$ and particulate matter, into the atmosphere.

SUMMARY OF THE INVENTION

The above and other objects, which will become apparent to one skilled in the art upon a reading of this disclosure, are attained by the present invention one aspect of which is:

A combustion method comprising:

(A) injecting into the front portion of a combustion zone at least one stream of oxidant and at least one stream of fuel in a substoichiometric ratio and combusting said fuel and said oxidant in a fuel-rich, highly luminous, high momentum flame region to form combustion reaction products;

(B) creating a recirculation zone within the front portion of the combustion zone by passing at least one high velocity fluid stream through at least part of the front portion of the combustion zone;

(C) providing a charge containing water into the combustion zone and evaporating water from the charge;

(D) operating the front end of the combustion zone at negative pressure to cause ambient air to infiltrate into the front end of the combustion zone;

(E) passing combustion reaction products, evaporated water and infiltrated air into the recirculation zone, mixing them therein, and then aspirating the mixture into the high momentum flame region;

(F) reacting unburned fuel in the high momentum flame region with oxygen from the aspirated mixture to produce combustion gas; and (G) flowing resulting combustion gas containing particulate matter into a plug flow zone wherein the combustion gas flow is expanded to the periphery of the combustion zone, said plug flow zone being within the combustion zone downstream of the recirculation zone, and reducing the combustion gas temperature and the combustion gas velocity within the plug flow zone enhancing settling of particulate matter out of the combustion gas flow.

Another aspect of the invention is a combustion method comprising:

(A) injecting into the front portion of a combustion zone at least one stream of oxidant and at least one stream of fuel and combusting said fuel and said oxidant in a high momentum flame region to form combustion reaction products;

(B) creating a recirculation zone within the front portion of the combustion zone by passing at least one high velocity fluid stream through at least part of the front portion of the combustion zone;

(C) providing a charge containing water into the combustion zone and evaporating water from the charge;

(D) operating the front end of the combustion zone at negative pressure to cause ambient air to infiltrate into the front end of the combustion zone;

(E) passing combustion reaction products, evaporated water and infiltrated air into the recirculation zone, mixing them therein, and then aspirating the mixture into the high momentum flame region;

(F) reacting unburned fuel in the high momentum flame region with oxygen from the aspirated mixture to produce combustion gas;

(G) flowing resulting combustion gas containing particulate matter into a plug flow zone wherein the combustion gas flow is expanded to the periphery of the combustion zone, said plug flow zone being within the combustion zone downstream of the recirculation zone, and reducing the combustion gas temperature and the combustion gas velocity within the plug flow zone enhancing settling of particulate matter out of the combustion gas flow; and (H) adjusting the firing rate and the oxygen enrichment level to control temperature readings at the input end and the output end of the combustion zone.

As used herein the term "burner" means a device through which both oxidant and combustible matter are provided into a combustion zone.

As used herein the term "lance" means a device through which only one of oxidant or combustible matter is provided into a combustion zone.

As used herein the term "negative pressure" means local pressure within a combustion zone lower than ambient atmospheric pressure.

As used herein the term "plug flow zone" means a flow region in which the time-averaged gas velocities at all points are essentially the same and the gas properties are also the same at any cross section perpendicular to the axis of the zone.

As used herein the term "waste" means any material intended for Partial or total combustion within a combustion zone.

BRIEF DESCRIPTION OF THE DRAWINGS

FIG. 3 is a graphical representation of a representative temperature profile for a known recirculation combustion process.

FIG. 4 is a graphical representation of a representative temperature profile for the combustion method of this invention.

DETAILED DESCRIPTION

The invention will be described in detail with reference to the Drawings.

Figure 1:
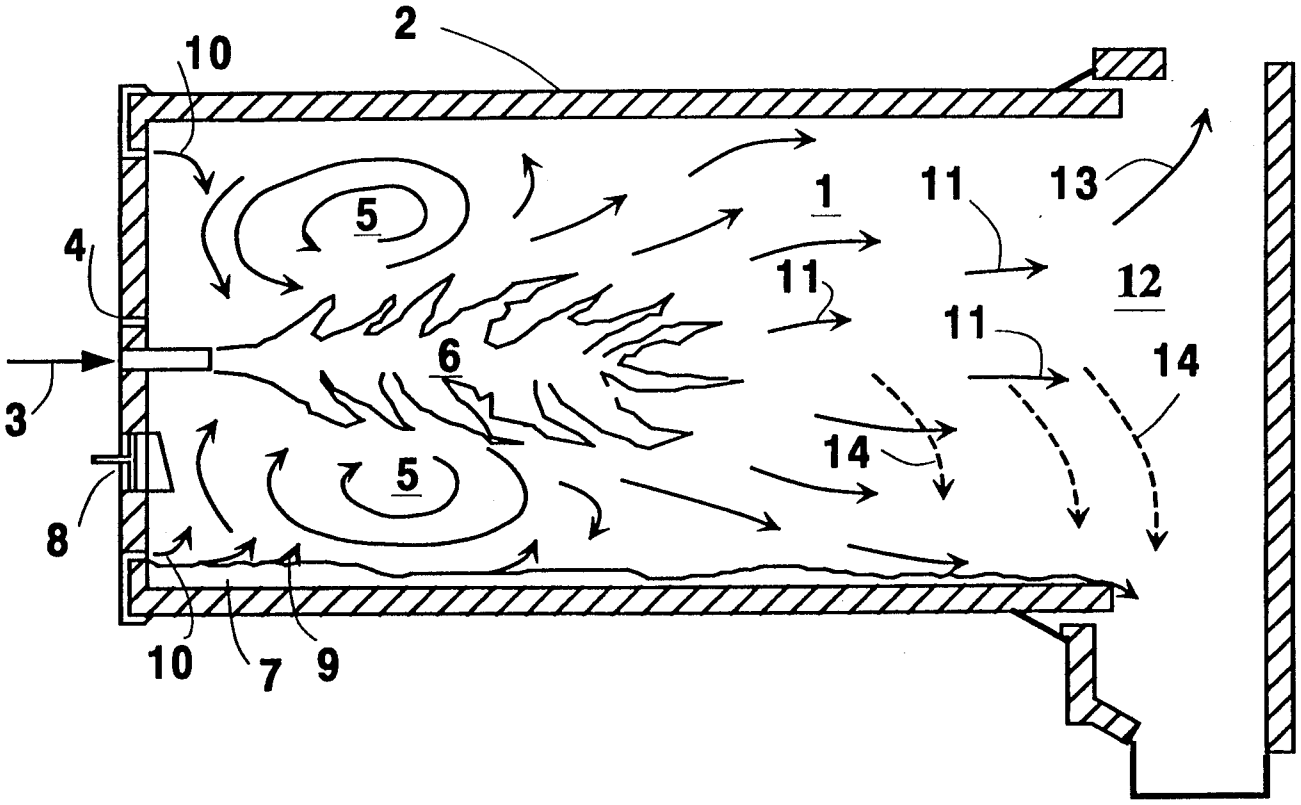
FIG. 1 is a cross-sectional representation of one preferred embodiment of the combustion method of this invention.
Figure 2:
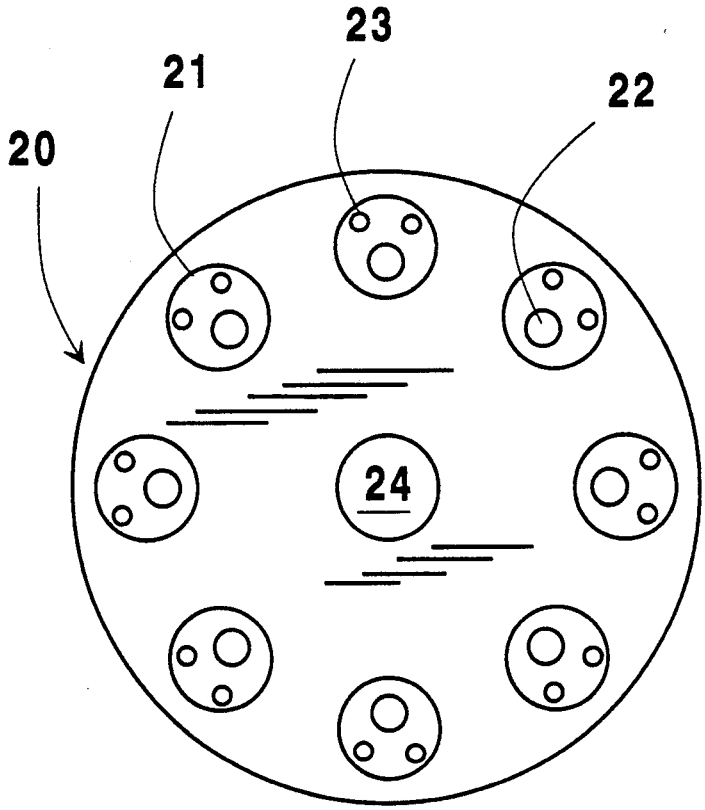
FIG. 2 is a view of one embodiment of a burner face useful for injection of fuel and oxidant into the combustion zone in the practice of this invention.

Referring now to FIG. 1 combustion zone 1 is contained within, for example, furnace or incinerator 2 which may be a rotary kiln. At least one stream of fuel and at least one stream of oxidant are injected into the front or upstream portion of the combustion zone such as through burner 3. The burner may have a burner face such as is illustrated in FIG. 2 for the injection of fuel and oxidant. Referring to FIG. 2, burner 20 comprises eight oxidant nozzles 21, each oxidant nozzle comprising one larger orifice 22, which may be oriented straight, and one or more smaller orifices 23, which may be oriented at an angle to that of orifice 22. The oxidant nozzles 21 are situated in a ring or circle around central fuel nozzle 24 from which fuel is injected into the combustion zone parallel to the direction that oxidant is injected through orifices 22. A preferred burner device is that disclosed in U.S. Pat. No. 4,969,814—Ho which enables facile adjustment of the angles of the fuel and oxidant streams so as to control the length and shape of the recirculation zone. Additional fuel or oxidant may be supplied to the combustion zone through lance 4. Alternatively both fuel and oxidant may be provided into the combustion zone through separate lances and a burner need not be employed.

The fuel may be any fluid fuel. Generic examples of suitable fluid fuels include a gas comprised of one or more gaseous components at least one of which is combustible, liquid fuel droplets dispersed in a gaseous medium, and solid fuel particles dispersed in a gaseous medium. Specific examples of suitable fluid fuels include fuel oil, natural gas, hydrogen, coke oven gas and propane.

The oxidant may be air, oxygen-enriched air or technically pure oxygen having an oxygen concentration of at least 99.5 percent. Preferably the oxidant comprises at least 25 percent oxygen and most preferably the oxidant is technically pure oxygen.

The fuel and oxidant are provided into the combustion zone in a substoichiometric ratio, i.e. a fuel-rich condition. Preferably the substoichiometric ratio is such that the ratio of oxygen to combustibles does not exceed 90 percent and most preferably is within the range of from 10 to 90 percent. In a preferred embodiment of the invention at least one of the fuel stream(s) or oxidant stream(s) is passed through at least a part of the front portion of the combustion zone at a high velocity sufficient to create a reduced pressure and consequently a strong recirculation zone 5 proximate the flame region in the front or upstream portion of the combustion zone. Such a velocity will be at least 150 feet per second. However, the recirculation zone within the front portion of the combustion zone may be created by passing any high velocity fluid stream through at least a part of the front portion of the combustion zone. For example, instead of, or in addition to, the aforesaid passage of at least one of the fuel or oxidant streams, the recirculation zone may be created by passing a high velocity inert fluid stream, such as steam, through at least a part of the front portion of the combustion zone.

The fuel and oxidant combustion in a fuel-rich, highly luminous, high momentum flame region 6. Due to the fuel-rich conditions and to the relatively high temperature which may be within the range of from 2500° to 3500° F., the combustion within the flame region is incomplete and results in the generation of soot particles which are highly luminous. This results in a high emissivity or heat transfer from the flame region to the charge and to the combustion zone, e.g. furnace or incinerator, walls. This rapid heat transfer reduces solids residence times required to reach the desired temperature. $NO_x$ generation is inhibited due to the fuel-rich (oxygen-deficient) conditions. The high velocity, in addition to causing a localized reduced pressure resulting in the formation of the recirculation zone within the combustion zone, also provides a high momentum to the flame region which enhances mixing within the flame region for more efficient subsequent combustion. The combustion within the flame region produces combustion reaction products which, in addition to the aforementioned highly luminous soot, may include carbon monoxide, carbon dioxide, hydrogen, hydrocarbons and water vapor.

Charge 7 is provided into combustion zone 1 such as through ram feeder 8. The charge contains water and may be sludge and/or solid waste. The charge may include, for example, contaminated soil containing solvents, halogenated hydrocarbons or creosote; scrap metals, wood, plastics or coal. The high emissivity heat transfer from flame region 6 causes water from charge 7 to evaporate and the resulting water vapor or steam 9 is passed into recirculation zone 5.

The front end of the combustion zone is operated at negative pressure. The aspiration effect of the high velocity jet or jets creates a lower pressure in the vicinity of the jets than the average pressure in the furnace or combustion zone. A negative local pressure may be created in the front end of the combustion zone as a consequence of the high velocity jets if the average combustion zone pressure is near or lower than atmospheric pressure. An induced fan or eductor may be employed to pull gas through the combustion zone to assist in establishing or maintaining the negative pressure within the front portion of the combustion zone.

As a result of the increased negative pressure at the front end of the combustion zone, ambient air is caused to infiltrate into the combustion zone such as is shown by arrows 10. This simultaneously accomplishes two things. First, it ensures that fugitive emissions from the combustion zone are prevented. Second, it provides oxygen into the combustion zone to complete the combustion of the fuel.

Combustion reaction products, evaporated water and infiltrated air are passed into the recirculation zone wherein they are mixed to form a mixture having an oxygen concentration generally within the range of from 2 to 10 percent. The resulting mixture is then aspirated into the high momentum flame region. Unburned fuel within the high momentum flame region is combusted with the dilute oxygen-containing aspirated mixture. The dilute nature of the oxygen within the aspirated mixture, along with its moisture-laden character, serve to ensure that the combustion with the unburned fuel is at a relatively low flame temperature ensuring reduced $NO_x$ generation. The high momentum causes high turbulence resulting in better mixing and good combustion efficiency. Soot particles are largely burned out in this region. The combustion and recirculation result in the production of combustion gases which contain entrained particulate matter.

The combustion gases pass from the flame region 6 as shown by arrows 11 into plug flow zone 12 which is within combustion zone 1 but downstream of recirculation zone 5. In the plug flow zone, the fluid flows predominantly along the axis of the combustion zone with essentially the same speed at all points. Meanwhile, the fluid properties, such as temperature, density, etc., are uniform across the plane that is perpendicular to the plug flow zone axis. In order to achieve uniform velocity profiles, the ratio of the distance from the front end of the combustion zone to the onset of the plug flow zone to the diameter of the combustion zone should exceed 3. This eliminates entrance effects such as initial tangential or radial velocity. The plug flow zone begins at about the point when the combustion gas jet flow from the upstream portion of the combustion zone is expanded and extends to the periphery or walls of the combustion zone thereby eliminating any recirculation flow beyond this point. Furthermore, the jet velocity would normally dissipate completely at a distance of about 200 jet diameters from the injection point. Uniform gas properties are attained when the combustion gases are well mixed prior to flowing into the plug flow zone so as to avoid stratification.

As a consequence of passing through the plug flow zone, the temperature of the combustion gas is reduced by continuously losing heat to the solids bed and through the shell wall of the combustion zone since the lower the flue gas mass flow the higher is the temperature drop. In addition, the reduction or elimination of nitrogen from the combustion gas flow due to the use of oxygen-enriched air or pure oxygen as the oxidant further increases the temperature drop through the plug flow zone by a significant amount.

The reduced combustion gas temperature causes a reduction in the combustion gas velocity such as out exhaust 13. According to the ideal gas law, gas volume is directly proportional to the absolute temperature of the gas. In the plug flow zone, the gas velocity is calculated by dividing the volumetric flow rate of the gas through the plug flow zone by the cross sectional area of the zone. Thus, as the temperature of the gas in the plug flow zone drops, the gas velocity is correspondingly reduced.

The reduced combustion gas velocity causes particulate matter carried in the combustion gas flow to settle out of the combustion gas as shown at 14.

Thus, by the method of this invention, one can conduct highly emissive combustion characterized by the generation of highly luminous soot particles so as to provide rapid heat transfer out from the flame region, while avoiding the release from the combustion zone of a large amount of particulate matter which results from the soot generation and entrainment. The initial substoichiometric combustion inhibits $NO_x$ generation. The establishment of the recirculation zone and the dilution of infiltrated air with water vapor and combustion reaction products in the recirculation zone prior to aspiration into the flame region ensures that the completion of the combustion of the fuel does not produce high $NO_x$ levels. The high velocity flow results in high momentum and thus sufficient turbulence in the flame region to achieve well mixed conditions and thus efficient overall combustion.

In order to more clearly demonstrate the temperature effects of the method of this invention, reference is made to FIGS. 3 and 4. FIG. 3 illustrates the typical temperature profile observed with the known recirculation type process such as that of U.S. Pat. No. 4,863,371. In FIGS. 3 and 4 temperature is shown on the vertical axis and distance from the injection or front end of the combustion zone is shown on the horizontal axis as a fraction of the total distance or length from the input to the output end of the combustion zone. Typically, the length of the combustion zone will be within the range of from 15 to 100 feet. Curve A represents the temperature of the gas, curve B represents the temperature of the refractory or wall and curve C represents the temperature of the charge or waste in the lower part of the combustion zone. As can be seen, the gas temperature remains relatively constant throughout the length of the combustion zone. FIG. 4 illustrates the typical temperature profile observed with the method of this invention. Curves A, B and C illustrate the temperatures of the gas, refractory and charge respectively, in the same fashion as that of FIG. 3. As can be seen, with the method of this invention, the gas avoids a very high temperature and thus avoids hot spots in the front portion of the combustion zone as is the case with the prior art process but, in contrast to the prior art process, undergoes a sharp temperature reduction in the downstream portion of the combustion zone. The significance of this sharp temperature reduction was previously discussed. However, the temperature of the charge or waste continues to rise. This indicates that heat continues to penetrate into the charge or waste driving out contaminants without overheating the ash.

Now by the use of the present invention, one can carry out combustion, such as waste incineration, with high heat flux and thus more rapid processing while avoiding the generation of large amounts of $NO_x$ and avoiding the emission of large amounts of particulate matter from a combustion zone such as a kiln.

Since the temperature of the recirculation zone is relatively uniform, a thermocouple installed on the face portion of the combustion zone or kiln could indicate the zone temperature. In the practice of this invention, one can simultaneously and independently control this temperature reading and the exit gas temperature by adjusting the firing rate and enrichment level of the oxidants. The firing rate is the heat output of the combustion reaction and the enrichment level is the oxygen percentage of the oxidant. As discussed earlier, the higher is the enrichment level, the lower is the flue gas volume in the plug flow zone; the lower is the flue gas volume the greater is the temperature drop in the plug flow zone. For example, one can control the exit temperature by adjusting the firing rate and adjusting the enrichment level to control the temperature at the feed end. The reverse may also be carried out. One can also adjust the angles of the fuel and oxidant streams to control the lengths of the recirculation zone and the plug flow zone, thereby controlling the temperature difference between the two portions of the combustion zone or kiln. The adjustment of the firing rate and oxidant enrichment level to simultaneously control the temperature at the input end and the output end of the combustion zone is attainable with the linearly aligned recirculation zone and plug flow zone and thus it is not necessary that the initial combustion be under substoichiometric conditions with a highly luminous flame. The initial combustion may be under stoichiometric or superstoichiometric conditions.

Although the invention has been described in detail with reference to certain preferred embodiments, those skilled in the art will recognize that there are other embodiments of the invention within the spirit and the scope of the claims.

I claim:

1. A combustion method comprising (A) injecting into the front portion of a combustion zone at least one stream of oxidant and at least one stream of fuel in a substoichiometric ratio and incompletely combusting said fuel with said oxidant in a fuel-rich, highly luminous, high momentum flame region to form combustion reaction products including highly luminous soot particles;

(B) creating a recirculation zone within the front portion of the combustion zone by passing at least one high velocity fluid stream through at least part of the front portion of the combustion zone, (C) providing a charge containing water into the combustion zone and evaporating water from the charge;

(D) operating the front end of the combustion zone at negative pressure to cause ambient air to infiltrate into the front end of the combustion zone;

(E) passing combustion reaction products, evaporated water and infiltrated air into the recirculation zone, mixing them therein, and then aspirating the mixture into the high momentum flame region;

(F) reacting unburned fuel in the high momentum flame region with oxygen from the aspirated mixture to produce combustion gas; and (G) passing resulting combustion gas containing particulate matter into a plug flow zone wherein the combustion gas flow is expanded to the periphery of the combustion zone, said plug flow zone being within the combustion zone downstream of the recirculation zone, and reducing the combustion gas temperature and the combustion gas velocity within the plug flow zone thereby enhancing settling of particulate matter out of the combustion gas flow.

2. The method of claim 1 wherein the combustion zone is an incineration zone.

3. The method of claim 1 wherein the charge comprises waste.

4. The method of claim 1 wherein the oxidant is air.

5. The method of claim 1 wherein the oxidant has an oxygen concentration of at least 25 percent.

6. The method of claim 1 wherein the oxidant is technically pure oxygen.

7. The method of claim 1 wherein the substoichiometric ratio of oxygen to fuel is within the range of from 0.10 to 0.90.

8. The method of claim 1 wherein the said high velocity fluid stream(s) has a velocity of at least 150 feet per second.

9. The method of claim 1 wherein the high velocity fluid stream(s) comprises at least one oxidant stream.

10. The method of claim 1 wherein the high velocity fluid stream(s) comprises at least one fuel stream.

11. The method of claim 1 wherein the high velocity fluid stream(s) comprises at least one inert fluid stream.

12. The method of claim 11 wherein the inert fluid is steam.

13. The method of claim 1 wherein the oxidant stream(s) and the fuel stream(s) are injected into the combustion zone through a burner.

14. The method of claim 1 wherein at least one of the oxidant stream(s) and the fuel stream(s) are injected into the combustion zone through a lance.

15. The method of claim 1 wherein the injection angle of at least one fuel stream or at least one oxidant stream is adjusted.

16. The method of claim 1 wherein the firing rate and oxygen enrichment level are adjusted to control the temperature readings at the input end and the output end of the combustion zone.

17. A combustion method comprising:

(A) injecting into the front portion of a combustion zone at least one stream of oxidant and at least one stream of fuel and incompletely combusting said fuel with said oxidant in a high momentum flame region to form combustion reaction products including highly luminous soot particles;

(B) creating a recirculation zone within the front portion of the combustion zone by passing at least one high velocity fluid stream through at least part of the front portion of the combustion zone;

(C) providing a charge containing water into the combustion zone and evaporating water from the charge;

(D) operating the front end of the combustion zone at negative pressure to cause ambient air to infiltrate into the front end of the combustion zone;

(E) passing combustion reaction products, evaporated water and infiltrated air into the recirculation zone, mixing them therein, and then aspirating the mixture into the high momentum flame region;

(F) reacting unburned fuel in the high momentum flame region with oxygen from the aspirated mixture to produce combustion gas;

(G) flowing resulting combustion gas containing particulate matter into a plug flow zone wherein the combustion gas flow is expanded to the periphery of the combustion zone, said plug flow zone being within the combustion zone downstream of the recirculation zone, and reducing the combustion gas temperature and the combustion gas velocity within the plug flow zone thereby enhancing settling of particulate matter out of the combustion gas flow; and (H) adjusting the firing rate and the oxygen enrichment level to control temperature readings at the input end and the output end of the combustion zone.

* * * * *